US007931402B1

(12) United States Patent
Oas

(10) Patent No.: US 7,931,402 B1
(45) Date of Patent: Apr. 26, 2011

(54) INFLATABLE GIFT WRAP IN THE SHAPE OF A CAKE

(75) Inventor: Daniel Oas, Irwindale, CA (US)

(73) Assignee: Calibre International, LLC, Irwindale, CA (US)

( * ) Notice: Subject to any disclaimer, the term of this patent is extended or adjusted under 35 U.S.C. 154(b) by 916 days.

(21) Appl. No.: 11/895,066

(22) Filed: Aug. 22, 2007

(51) Int. Cl.
*B65D 30/00* (2006.01)
*B65D 33/16* (2006.01)
*B65D 73/00* (2006.01)
*B65D 81/02* (2006.01)

(52) U.S. Cl. ..... 383/3; 383/66; 383/907; 206/457; 206/522

(58) Field of Classification Search ..... 383/3, 66, 383/907; 206/457, 522; 446/220–226; 229/87.18, 229/87.19
See application file for complete search history.

(56) References Cited

U.S. PATENT DOCUMENTS

| | | | | |
|---|---|---|---|---|
| 1,125,855 | A | 1/1915 | Mapes | |
| D157,043 | S | 1/1950 | Gruber | |
| 2,758,458 | A | 8/1956 | Carlson | |
| 3,587,794 | A | 6/1971 | Mattel | |
| 3,819,455 | A | 6/1974 | MacKendrick | |
| 3,891,082 | A * | 6/1975 | Fall | 206/8 |
| 4,044,867 | A | 8/1977 | Fisher | |
| 4,085,785 | A | 4/1978 | Hoot | |
| 4,091,852 | A | 5/1978 | Jordan et al. | |
| 4,219,119 | A | 8/1980 | Zefran | |
| 4,573,202 | A | 2/1986 | Lee | |
| D283,845 | S | 5/1986 | Lief et al. | |
| 4,597,244 | A * | 7/1986 | Pharo | 53/434 |
| 4,612,781 | A | 9/1986 | Swerdon | |
| 4,809,352 | A | 2/1989 | Walker | |
| D333,592 | S | 3/1993 | Walker | |
| 5,217,131 | A | 6/1993 | Andrews | |
| 5,254,026 | A * | 10/1993 | Kaiser | 446/220 |
| 5,348,155 | A * | 9/1994 | Ishiwa | 206/457 |
| D371,960 | S | 7/1996 | Cheng | |
| D376,101 | S | 12/1996 | Lippens | |
| 5,692,833 | A | 12/1997 | DeLuca | |
| 5,833,069 | A * | 11/1998 | Jones | 206/522 |
| D419,438 | S | 1/2000 | Gardner | |
| D440,121 | S | 4/2001 | Peterson | |
| D443,182 | S | 6/2001 | Peterson | |
| 6,305,545 | B1 * | 10/2001 | Morrow | 206/522 |
| 6,866,813 | B1 * | 3/2005 | Trubitt | 264/523 |
| 6,962,284 | B1 * | 11/2005 | Hartelius et al. | 232/38 |
| D523,704 | S | 6/2006 | DiBiasi | |
| 7,066,331 | B2 * | 6/2006 | Koyanagi et al. | 206/522 |
| 2003/0155268 | A1 * | 8/2003 | Wang | 206/522 |
| 2006/0278650 | A1 * | 12/2006 | Randall | 220/737 |
| 2007/0023439 | A1 | 2/2007 | Vaughn | |
| 2009/0081917 | A1 * | 3/2009 | Greenwald | 446/74 |

* cited by examiner

*Primary Examiner* — Jes F Pascua
(74) *Attorney, Agent, or Firm* — Thomas I. Rozsa

(57) ABSTRACT

An inflatable container formed in the shape of a cake and designed to resemble a cake, with a door on one side through which a gift is placed inside the container. A preferred embodiment of the container is in a generally rectangular shape with additional inflatable elements that give the container an overall general appearance of a birthday cake, with 'candles' and 'icing' that inflate with the inflation of the container. The container is preferably opaque so that the gift inside cannot be seen until opened.

23 Claims, 7 Drawing Sheets

INFLATABLE GIFT WRAP IN THE SHAPE OF A CAKE

BACKGROUND OF THE INVENTION

1. Field of the Invention

This invention relates to a novel inflatable container for an object. Specifically, the invention relates to a novel inflatable and deflatable container for articles, including hard to wrap items such as canned and bottled drinks.

2. Description of the Prior Art

Heretofore, several types of inflatable coolers and carriers have been devised for carrying food and luggage. These prior art inflatable luggage and shipping pieces utilize air chambers sometimes located in the walls and structure and rigid sheet material, which hindered the collapse of the device. The prior art inflatable coolers are generally shaped as a chest with a lid or opening at or across the upper surface.

It is also known to use inflatable containers for transportation of fragile and delicate items, such as cameras, china, and crystal, etc., or for carrying personal items such as clothing, papers, or the like. The former inflatable containers are generally designed to inflate around the fragile object and thereby freeze it in place to prevent its movement in the container and provide shock absorbence and impact resistance to protect the article within. The latter inflatable containers are generally constructed and formed into the shape and size of a suitcase or briefcase and function completely as a suitcase or briefcase. Some prior art include a means to pump the air into the device.

The following 23 patents are relevant to the field of the present invention.

1. U.S. Pat. No. 3,587,794 issued to Howard Mattel on Jun. 28, 1971 for "Air-Inflated Collapsible Suitcase" (hereafter the "Mattel Patent");

2. U.S. Pat. No. 4,044,867 issued to Robert J. Fisher on Aug. 30, 1977 for "Inflatable Luggage" (hereafter the "Fisher Patent");

3. U.S. Pat. No. 4,085,785 issued to Eric F. Hoot and assigned to The Raymond Lee Organization Inc. on Apr. 25, 1978 for "Inflatable Cooler Container" (hereafter the "Hoot Patent");

4. U.S. Pat. No. 4,612,781 issued to Paul M. Swerdon on Sep. 23, 1986 for "Inflatable Insulated Barrel Cooler" (hereafter the "Swerdon Patent");

5. U.S. Pat. No. 4,091,852 issued to Charles P. Jordan et al. on May 30, 1978 for "Inflatable Box" (hereafter the "Jordan Patent");

6. U.S. Pat. No. 4,573,202 issued to Aaron Lee on Feb. 25, 1986 for "Container with Inflatable, Floating Liner Of Uniform Thickness" (hereafter the "Lee Patent");

7. U.S. Design Patent No. Des. 283,845 issued to Joseph R. Lief et al. and assigned to M. Dale Smith on May 20, 1986 for "Inflatable Insulated Carrying Container" (hereafter the "Lief Patent");

8. U.S. Pat. No. 4,809,352 issued to Kyle B. Walker on Feb. 28, 1989 for "Inflatable Cooler" (hereafter the "Walker Patent");

9. U.S. Design Pat. No. Des. 333,592 issued to Kyle B. Walker on Mar. 2, 1993 for "Inflatable Cooler" (hereafter the "Walker Design Patent");

10. U.S. Pat. No. 5,217,131 issued to Catherine M. L. Andrews on Jun. 8, 1993 for "Shipping Container Apparatus" (hereafter the "Andrews Patent");

11. U.S. Design Pat. No. D443,182 issued to Leroy L. Peterson and assigned to Sportsstuff Inc. on Jun. 5, 2001 for "Inflatable Cooler" (hereafter the "Peterson Design Patent");

12. U.S. Design Pat. No. D523,704 issued to Glenn L. DiBiasi on Jun. 27, 2006 for "Cake Condom" (hereafter the "DiBiasi Design Patent");

13. U.S. Published patent application No. 2007/0023439 issued to James Elmer Vaughn on Feb. 1, 2007 for "Inflatable Cooler" (hereafter the "Vaughn Patent").

14. U.S. Pat. No. 1,125,855 issued to Bessie June Mapes on Jan. 19, 1915 for "Table Decoration" (hereafter the "Mapes Patent");

15. U.S. Design Pat. No. Des. 157,043 issued to Gilbert S. Gruber et al. and assigned to Oxford Products Corp. on Jan. 31, 1950 for "Gift Box" (hereafter the "Gruber Design Patent");

16. U.S. Pat. No. 2,758,458 issued to Dewayne C. Carlson on Aug. 14, 1956 for "Birthday Cake Cover With Base" (hereafter the "Carlson Patent");

17. U.S. Pat. No. 3,819,455 issued to Edith P. MacKendrick on June 25, 1974 for "Cake Protector And Candle Holder" (hereafter the "MacKendrick Patent");

18. U.S. Pat. No. 4,219,119 issued to Clara M. Zefran on Aug. 26, 1980 for "Decorative Cake Container" (hereafter the "Zefran Patent");

19. U.S. Design Pat. No. Des. 371,960 issued to Kui-Eng Chen on Jul. 23, 1996 for "Cake Gift Box" (hereafter the "Chen Design Patent");

20. U.S. Design Pat. No. Des. 376,101 issued to Gerd Lippens and assigned to Ballon-Express S. A. on Dec. 3, 1996 for "Packaging For Confectionery" (hereafter the "Lippens Design Patent");

21. U.S. Pat. No. 5,692,833 issued to Nicholas Paolo DeLuca and assigned to Novus Packaging on Dec. 2, 1997 for "Inflatable Packaging Cone And Method Of Making The Same" (hereafter the "DeLuca Patent");

22. U.S. Design Pat. No. Des. 419,438 issued to Donna Marie Gardner on Jan. 25, 2000 for "Cake Gift Box" (hereafter the "Gardner Design Patent");

23. U.S. Design Pat. No. D440,121 issued to LeRoy L. Peterson and assigned to Sportsstuff, Inc. on Apr. 10, 2001 for "Inflatable Cooler" (hereafter the "Peterson Design Patent").

The Mattel Patent is for an inflatable suitcase which contains exterior pockets so that air can be blown into the pockets through a nipple which results in the suitcase being in the expanded full condition and when air is released so that the suitcase can be in a flat condition.

The Fisher Patent discloses inflatable luggage which can be in various shapes. The containers have walls which are formed of fluid impervious material and a conduit is connected to the passages for the purposes of inflating the container.

The Hoot Patent is essentially an inflatable ice chest container which has inflatable sidewalls. The Hoot Patent also has a hard plastic interior liner, in which food is stored, that is placed within the sidewalls. The cover also can be inflated. The device has a thermal insulation-like property and is used to retain the hot or cold qualities of food stored within.

The Swerdon Patent is an inflatable insulated lidless cooler specifically designed to accommodate and cool large barrels of beer. It has cylindrical walls which can be inflated. The inflatable wall serves as an insulation for the ice and barrel of beer.

The Jordan Patent discloses an inflatable group of panels joined along fold lines, which when folded, form a box which are thereafter retained together by snap fasteners. When the air is released, the device folds flat.

The Lee Patent discloses a container having a casing member and a liner in which an inflatable envelope resides and functions as a shock absorber for the contents therein such as a camera. The inflatable shock absorber lies in the space formed between the outer casing of the container and the liner which receives the inflatable envelope and is inserted through the unsewn sides between the edge of the outer casing and side liner. This opening however can be closed for example by a zipper or snap button. Built into the case is a bulbous pump to inflate the shock absorber.

The Lief Patent is a design patent for an inflatable insulated carrying container. The carrier has three separate sections that must be inflated individually. When inflated, the two end walls and the one wrap around connecting sidewall are form a tubular shape. A handle attaches to the carrier so that the tube hangs horizontally. A zipper runs along the sidewall between the two attached ends of the handle, resulting in a purse-like appearance to the carrier.

The Walker Patent discloses an inflatable cooler having an inflatable container and inflatable lid. Secured to the bottom wall of the inflatable container is a reinforcing member for supporting the weight of objects carried in the container. The shape of the container and lid is that of a standard ice chest and is maintained by one or more support strips secured within the walls of the container and within the lid.

The Walker Design Patent is of an inflatable cooler that appears to have inflatable sidewalls which can be inflated with air to cause the container to be in the expanded full condition and from which air can be released to enable the container to be flattened.

The Andrews Patent is a pneumatic shipping container comprising a rigid shell container and lid with an inflatable liner positioned therein. The inflatable liner is arranged for mounting to anchor portions within the container for positioning the liner relative to the container structure. The object to be shipped is placed within and the liner is inflated around the object to cushion and prevent movement of the object in the shipping container.

The Peterson Patent is a design patent for an inflatable cooler. The cooler inflates into a shape that appears to be made to float in water. A zipper encircles the upper rim of the storage area so that entire top lifts back to add or remove the food and drink within.

The DiBiasi Patent which is a design patent that issued in 2006 for a 'cake condom' and appears to be made of a rigid, hard plastic roughly in the shape of a bread box. The top surface has a multiplicity of air holes that encircle the words 'happy birthday' printed across the top.

The Vaughn Published Patent Application discloses an inflatable cooler having an inflatable body within a rigid frame and base and at least one fluid chamber connected to the base and to the upper frame.

The Mapes Patent is a table decoration in the shape of a birthday cake.

The Gruber Patent is a design patent which protects the shape of the object. It is simply a hingeable container which can simulate a birthday cake with the word "Happy Birthday" thereon.

The Carlson Patent is a protective covering for cakes which has openings in which candles can be placed.

The MacKendrick Patent is a cake protector and candle holder which is a shield to be placed over the birthday cake so that it is inaccessible to insects and people while it is protected and the shield holds candles so that the candles can be lit and simulate a birthday cake but the candles themselves will not touch the birthday cake.

The Zefran Patent is a decorative cake container which is a two-piece decorative cake container cover which includes removable decorations on the cake.

The Cheng Patent is a cake gift box which has a solid cylindrical top designed to cover a cake with a simulated candle therein.

The Lippens Patent is a design patent for packaging for a confectionery which is a blow-up type of form placed on top of a package where the confectionery is placed.

The DeLuca Patent is a two dimensional inflatable heat sealable thin filled form to create a three dimensional inflated cone with a recess in the base of the cone useful as a carrying pouch or as an end cap for a cushioning as well as thermal protection. The cone has the word "Happy Birthday" on it. This is an inflatable device which can be used to carry articles and also can have the words "Happy Birthday" as the gift can be placed in the container.

The Gardner Patent is a cake gift box and is designed to protect several tiers of a wedding cake. It has a simulated bride and groom on the top of the cake but is a hard physical box and not a blow-up box.

The Peterson Design Patent discloses an inflatable cooler which in general can simulate a ring with a cake in the middle but there is no opening in which an object can be placed.

Most of the prior are complicated devices, made of multiple pieces and components and of differing materials. Heretofore the prior art does not include an inflatable device that is in a shape of other than that of a cooler or a case. The prior art does not provide for a case suitable for closely, but not immovably, holding and carrying a six bottles of or a six-pack of canned drinks. The prior art also does not provide for an inflatable and deflatable means to package articles as gifts. The prior art also does not provide for an inflatable and deflatable means to package unusual and hard to wrap items as gifts, such as six bottles or a six-pack of canned drinks. The prior art does not teach an inflatable and deflatable means to package gifts in a fun and fanciful manner.

SUMMARY OF THE INVENTION

To overcome the limitations of the prior art, the present invention involves the concepts of wrapping gifts in a box-like structure that is inflatable and deflatable and having an outside that can take many forms and is an appropriate, easy and convenient method to present as a gift any item, including items that are notoriously hard to wrap, such as a six-pack of beer.

Typically, when a person wishes to make a gift of a six-pack of a special brew of beer or a favorite brew, the gift is presented unwrapped, as it is a very difficult gift to wrap The cans are loose on the bottom, the cans are heavy, cylinder shapes are hard to wrap, six individually wrapped cans are bulky and awkward. The same is true if a person wants to make a gift of bottled drinks.

The present invention is an inflatable container formed in the shape of a cake and designed to resemble a cake, with a door on one side through which the gift is placed inside the container. A preferred embodiment of the container is in a generally rectangular shape with additional inflatable elements that give the container an overall general appearance of a birthday cake, with 'candles' and 'icing' that inflate with the inflation of the box. The container is preferably opaque so that the gift inside cannot be seen until opened. Colored printing on the exterior of the cake help to continue the illusion of a birthday cake by adding color to the 'icing' and 'candles' and also by printing decorative wording such as "Happy Birthday," "Happy Anniversary," "Happy 21$^{st}$ Birthday," "Happy New Year," "Happy Father's Day," "Congratulations," and the like. The box is made of some material that is air-impermeable, preferably a plastic or polymer.

Another style that the generally rectangular shaped gift box can take is that of a wrapped gift box with a bow and ribbons. In this style, a "bow with ribbons" is on the top surface of the box and is inflated when the box is inflated. Colored printing would include printing of the 'bow,' a 'ribbon' or 'wrapping paper.' The colored printing might also include a 'gift tag' with 'To: From:' written on it and allow for the gift giver to write, indelibly or erasably, the recipient's name and the gift giver's name.

The rectangular inflatable container has a valve through which the user blows air into the container to inflate and squeezes air out to deflate. The valve has a stopper to help keep the air in. Also inflated with the container and the decorative elements on the outer surface of the container is a flap that is used as a door to cover the opening of the interior area where the gift is placed. The user opens the flap, places the gift inside on the floor of the interior cavity, and closes the flap. Thus, the gift is wrapped and ready to be presented. The flap may be attached to the container and swing open along any side of the opening to the interior of the container. The container inflates to a shape that includes a recess around the opening of the interior so that the closed flap lies within the plane of the surface of the side wall. The container also has an area that extends as an inflated flange over the opening to the interior and is oriented over the opening so that it corresponds to the end of the flap that is not attached to the container. This flange and its placement serve two functions. The first is to provide a stop point for the flap to prevent it from going into the interior of the container. The second is to provide an appropriate location to place a fastener on the container to correspond with a reciprocal fastener on the flap so as to keep the door closed and prevent it from opening freely. It will be seen that if the flap attaches to the box along the top of the cavity opening, there is less need, if any, for a fastener, as gravity will naturally keep the flap in a downward orientation, which would nearly correspond to a closed position.

The dimensions of the rectangular gift box are multiple, but one preferred dimension is such that the interior cavity has the capacity to contain a six-pack of canned drinks.

An alternate embodiment of the container, as a whole, is in a cylindrical shape. The cylindrical shape lends itself to having the overall appearance of a round, multi-layer birthday cake, complete with inflatable 'candles' and 'icing' as described above, or as a hat box, with inflated 'ribbons' and 'bows.' The cylindrical container operates, functions and is manufactured in a substantially similar manner as that of the rectangular embodiment. Like the rectangular container, the dimensions of the cylindrical container are multiple, but a preferred dimension is one that has the capacity to contain a six-pack of bottled drinks.

An alternative embodiment of the flap, regardless of the shape of the embodiment, is one wherein the flap is not inflated. In such an embodiment, the flap may be of a completely different material from that of the container and may be completely detached from the container and thus require some means to attach the flap to the container. A preferred alternative embodiment of the non-inflated flap is one wherein the flap is still formed as part of the container and made and painted during the container's manufacture, but is merely a solid piece of the air-impermeable material that forms the rest of the container. The recess where the flap lies is adjusted in depth, generally shortened, so that the flap, in the closed position, still lies generally within the plane of the sidewall surface.

The inflatable container, in general, is capable of being presented as a gag gift. Colored printing and inflatable decorative elements can be designed to give the container the appearance of a bomb, hazardous waste, a shoe box, a package of toilet paper, a stack of books, a tire, a laptop, a computer monitor, and the like. The inflatable container may also have inflatable decorative elements and colored printing of licensed material on it so as to conform with a toy or movie or character or theme, such as a Disney character or movie. The inflatable container may also have decorative elements and colored printing that does not require licensing, such as a palm tree inflated on top for a gift for a Hawaiian-themed party.

It is an object of the present invention to provide a novel, inflatable, collapsible container that will serve as a gift wrap for six bottles of or a six-pack of canned drinks that is pleasing in appearance, leak proof, collapsible for ease of storage when not use, and structurally rigid when in use to accommodate the difficult handling associated with carrying six bottles or a six pack of canned drinks. The present invention provides all of these features.

It is also an object of the present invention to provide a novel, inflatable, collapsible container that will serve as a gift wrap for six bottles of or a six-pack of canned drinks that is sturdy, light in weight, and inexpensive to manufacture. The present invention provides all of these features.

It is an additional object of the present invention to provide a novel, inflatable, collapsible container that will serve as a gift wrap for six bottles of or a six-pack of canned drinks that is inexpensive to manufacture and eliminates parts in the prior art. Prior art devices are complex, with multiple, varied contents all requiring varied systems of manufacture. Additionally, prior art that contains a multiplicity of parts, as well as complicated apparatuses, are expensive to manufacture. The present invention eliminates parts in the prior art and is easy and inexpensive to manufacture since the main body is only one molded or formed piece.

It is a further object of the present invention to provide a novel, inflatable, collapsible container that will serve as a gift wrap for six bottles of or a six-pack of canned drinks that is inexpensive to purchase. Due to the size, simplicity and uncomplicated nature of the present invention, the present invention will be inexpensive.

It is still a further object of the present invention to provide a novel, inflatable, collapsible container that will be used as a gift wrap for six bottles of or a six-pack of canned or bottled drinks that is durable, small and portable, marketable, and is appealing and desirable so that someone who sees one demonstrated by another person will want one too. The present invention provides all of these features.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
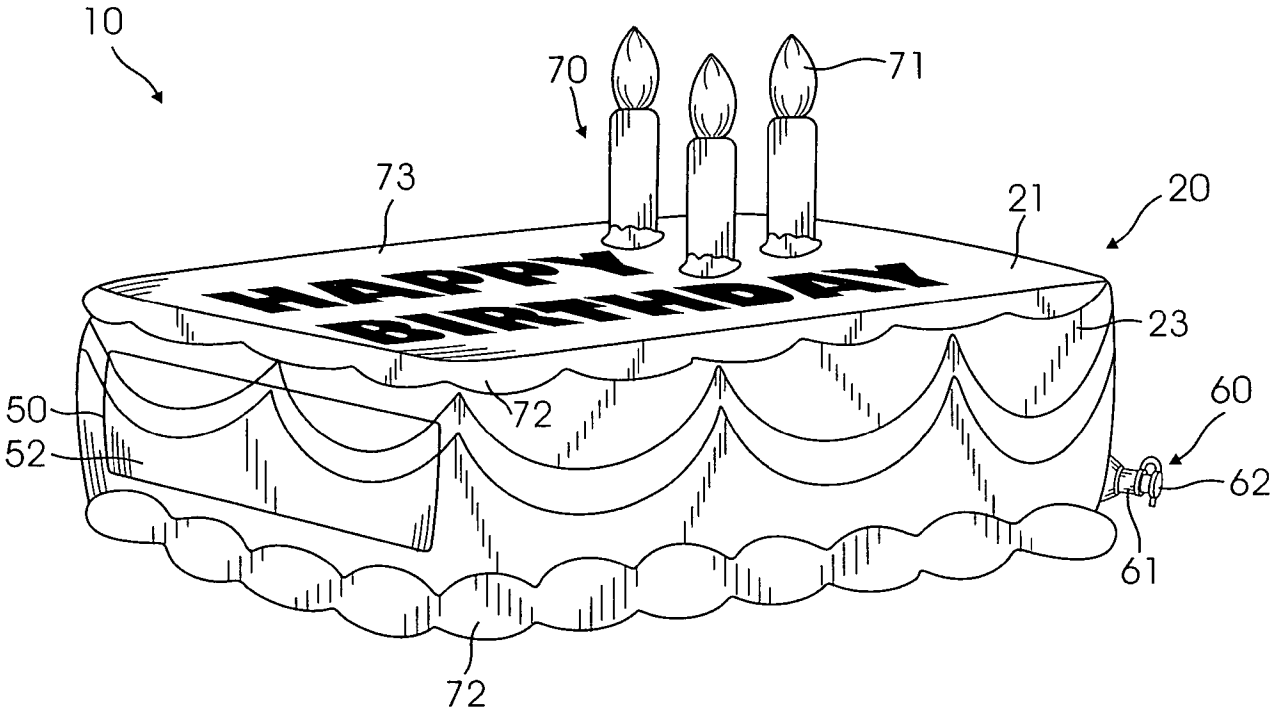
FIG. 1 is an illustration of a perspective view of a preferred embodiment of the inflatable container in the shape of a cake.
Figure 2:
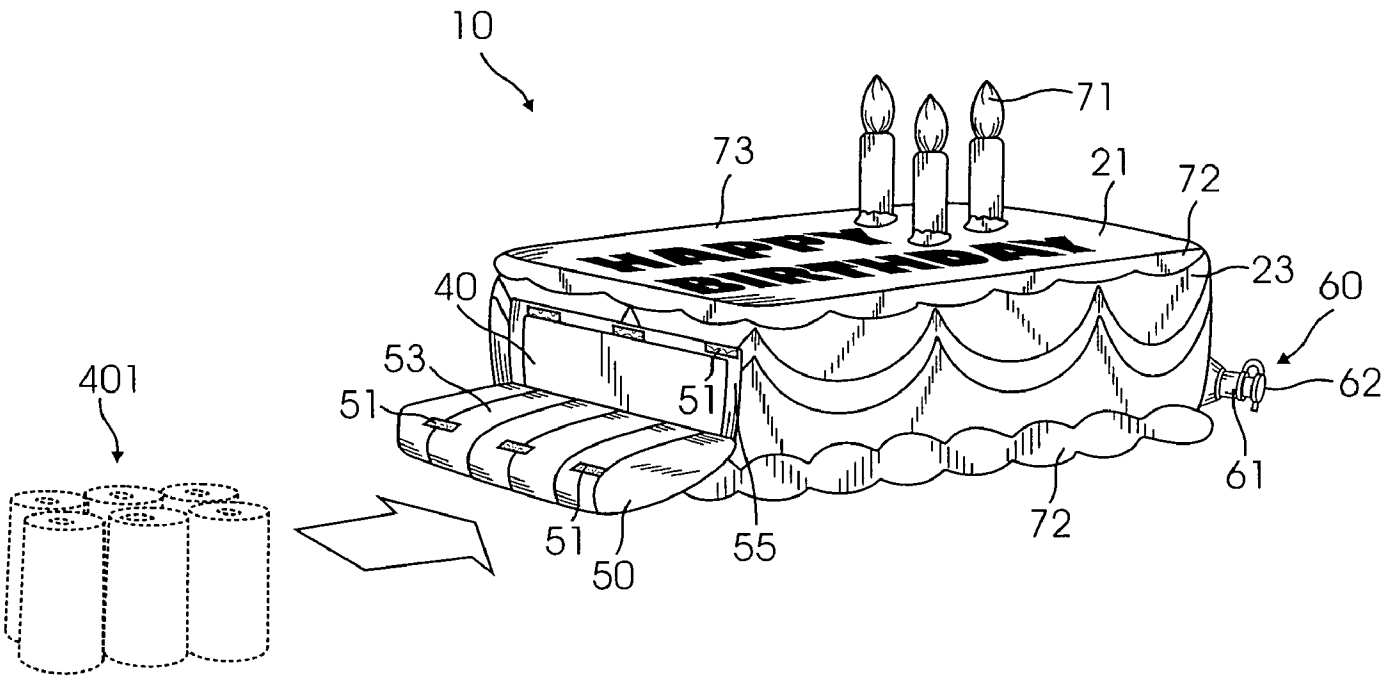
FIG. 2 is an illustration of a perspective view of a preferred embodiment of the inflatable container in the shape of a cake of FIG. 1 positioned with the flap open, shown in solid lines, and an article to be inserted, shown in phantom lines.

Turning now to the drawings, in which similar reference characters denote similar elements throughout the several views, in FIGS. 1 and 2 there is shown an outer surface 20 of a rectangular air bladder 10 designed to be in the shape of an inflated cake. The outer surface 20 forms an outer top wall 21, outer side walls 23, and outer bottom wall 22 (see FIG. 4). The whole of the device in a preferred embodiment inflates to imitate the appearance of a birthday cake.

Referring to FIGS. 1 and 2, on the outer surface 20 are decorative elements 70, which include ornamental top decorations 71, ornamental side decorations 72, and decorative wording 73. As illustrated in the preferred embodiment, the ornamental top decorations 71 inflate to form the shape of birthday candles with a flame and the ornamental side decorations 72 inflate to form the shape of icing on the cake. Ornamental top decorations 71 and ornamental side decorations 72 are formed from the outer surface 20 and are protruding shapes arising from the outer surface 20. Decorative wording 73 is appropriate to the style of the embodiment, and, in this case, reads, "Happy Birthday." Decorative wording 73 can vary and include a multiplicity of words and phrases, including, but not limited to, "Happy Anniversary," "To: From:," "Happy 21$^{st}$ Birthday," "Happy New Year," "Happy Father's Day," "Congratulations," and the like. Outer surface 20, decorative elements 70, ornamental top decorations 71, ornamental side decorations 72, and decorative wording 73 can be colored, inked, printed, or covered in stickers, and the like, in any combination of colors and patterns.

Figure 4:
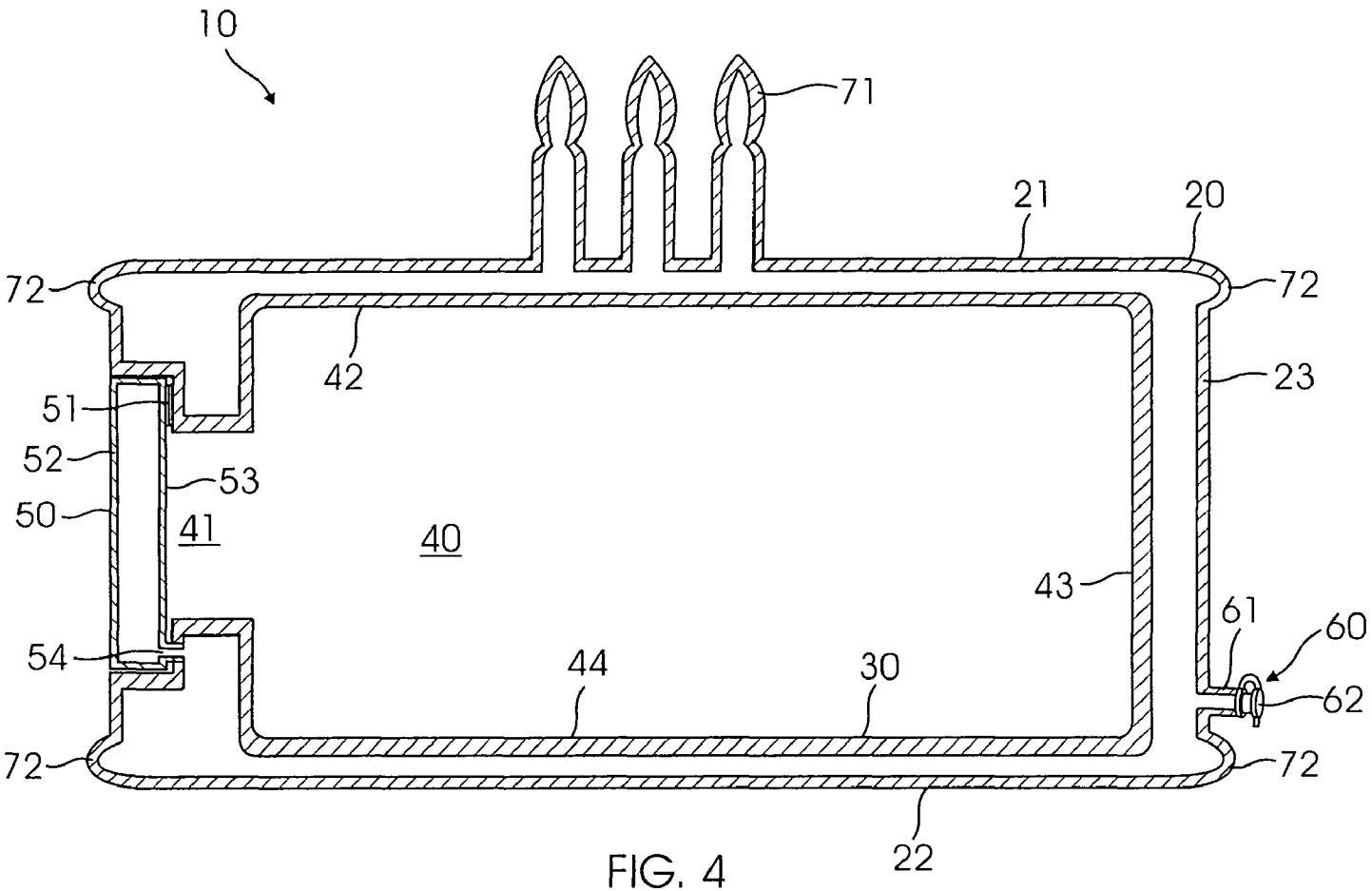
FIG. 4 is an illustration of an orthographic, cross-sectional, schematic representation view of the air flow pattern of a preferred embodiment of the inflatable container in the shape of a cake showing the flap in a closed position.

Referring to FIG. 4 in addition to FIGS. 1 and 2. on the outer surface 20 and formed from the rectangular air bladder 10 is a flap 50. Flap 50 resides along an outer sidewall 23 and covers cavity opening 41 (see FIG. 4). Flap 50 is held closed over cavity opening 41 by fasteners 51. Fasteners 51 can be hook and loop, light weight magnets, plastic magnets, snaps, zippers, resealable adhesives, and the like. Flap 50 is of a size, shape and color to completely cover cavity opening 41 and to maintain and correspond with the imitation of shape and color of outer surface 20. Flap 50 may also have corresponding decorative elements 70, ornamental top decorations 71, ornamental side decorations 72, and decorative wording 73, as appropriate.

Rectangular air bladder 10 is inflated by means of a valve 60. Valve 60 has a valve nipple 61 through which air enters to inflate the rectangular air bladder 10. A valve stopper 62 seals the valve nipple 61 to retain the air within. To deflate the rectangular air bladder 10, the valve stopper 62 is removed to open the valve nipple 61, through which the air may exit.

Rectangular air bladder 10 forms a cavity 40 in which articles, including a six-pack of canned drinks, may reside. Articles enter the cavity 40 through the cavity opening 41 and rest on cavity floor 44. The capacity of cavity 40 may be of any size, preferably one size being capable of at least containing a six-pack of canned drinks. Cavity opening 41 is of a size and shape to permit the entrance of articles to be placed therein.

Figure 3:
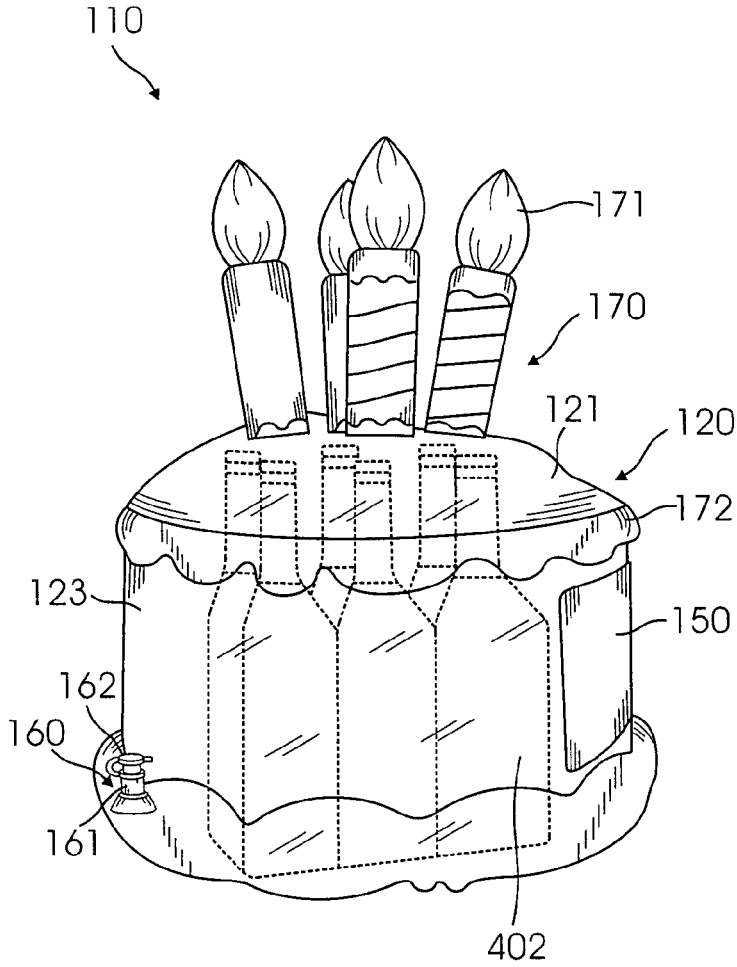
FIG. 3 is an illustration of a perspective view of an alternate embodiment of the inflatable container in the shape of a cake.

Referring to FIG. 3, there is shown an alternate embodiment that is substantially similar to that shown in FIGS. 1 and 2. The alternate embodiment in FIG. 3 is not rectangular, as previously discussed, but instead is circular so as to imitate the shape of a round cake. This alternate embodiment is a cylindrical air bladder 110 and is preferably of a height to accommodate bottled drinks. The outer surface 120 forms an outer top wall 121, outer side walls 123, and outer bottom wall (not shown).

On the outer surface 120 are decorative elements 170, which include ornamental top decorations in he shape of candles 171, ornamental side decorations 172, and decorative wording (not shown). As illustrated in this alternate embodiment, the ornamental top decorations 171 inflate to form the shape of birthday candles with a flame and the ornamental side decorations 172 inflate to form the shape of icing on the cake. Ornamental top decorations 171 and ornamental side decorations 172 are formed from the outer surface 120 and are protruding shapes arising from the outer surface 120. Decorative wording on the top surface 121 is appropriate to the style of the embodiment. The decorative wording can vary and include a multiplicity of words and phrases, including, but not limited to, "Happy Birthday," "Happy Anniversary," "To: From:," "Happy 21$^{st}$ Birthday," "Happy New Year," and the like. Outer surface 120, decorative elements 170, ornamental top decorations 171, ornamental side decorations 172, and decorative wording can be colored in any combination of colors and patterns.

On the outer surface 120 and formed from the rectangular air bladder 110 is a flap 150. Flap 150 resides along an outer side wall 123 and covers cavity opening comparable to the rectangular opening embodiment disclosed in FIGS. 1 and 2. Flap 150 is held closed over cavity opening by fasteners. Fasteners can be hook and loop, light weight magnets, plastic magnets, snaps, zippers, resealable adhesives, and the like. Flap 150 is of a size, shape and color to completely cover cavity opening and to maintain and correspond with the imitation of shape and color of outer surface 120. Flap 150 may also have corresponding decorative elements 170, ornamental top decorations 171, ornamental side decorations 172, and decorative wording, as appropriate.

Cylindrical air bladder 110 is inflated by means of a valve 160. Valve 160 has a valve nipple 161 through which air enters to inflate the rectangular air bladder 110. A valve stopper 162 seals the valve nipple 161 to retain the air within. To deflate the rectangular air bladder 110, the valve stopper 162 is removed to open the valve nipple 161, through which the air may exit.

Cylindrical air bladder 110 forms a cavity (comparable to 40 illustrated in FIG. 1) in which articles, including six bottles of drinks, may reside. Articles enter the cavity through a cavity opening and rest on cavity floor. The capacity of the cavity may be of any size, preferably one size being capable of at least containing six bottled drinks illustrated in phantom in FIG. 3. The cavity opening is of a size and shape to permit the entrance of articles to be placed therein.

Figure 5:
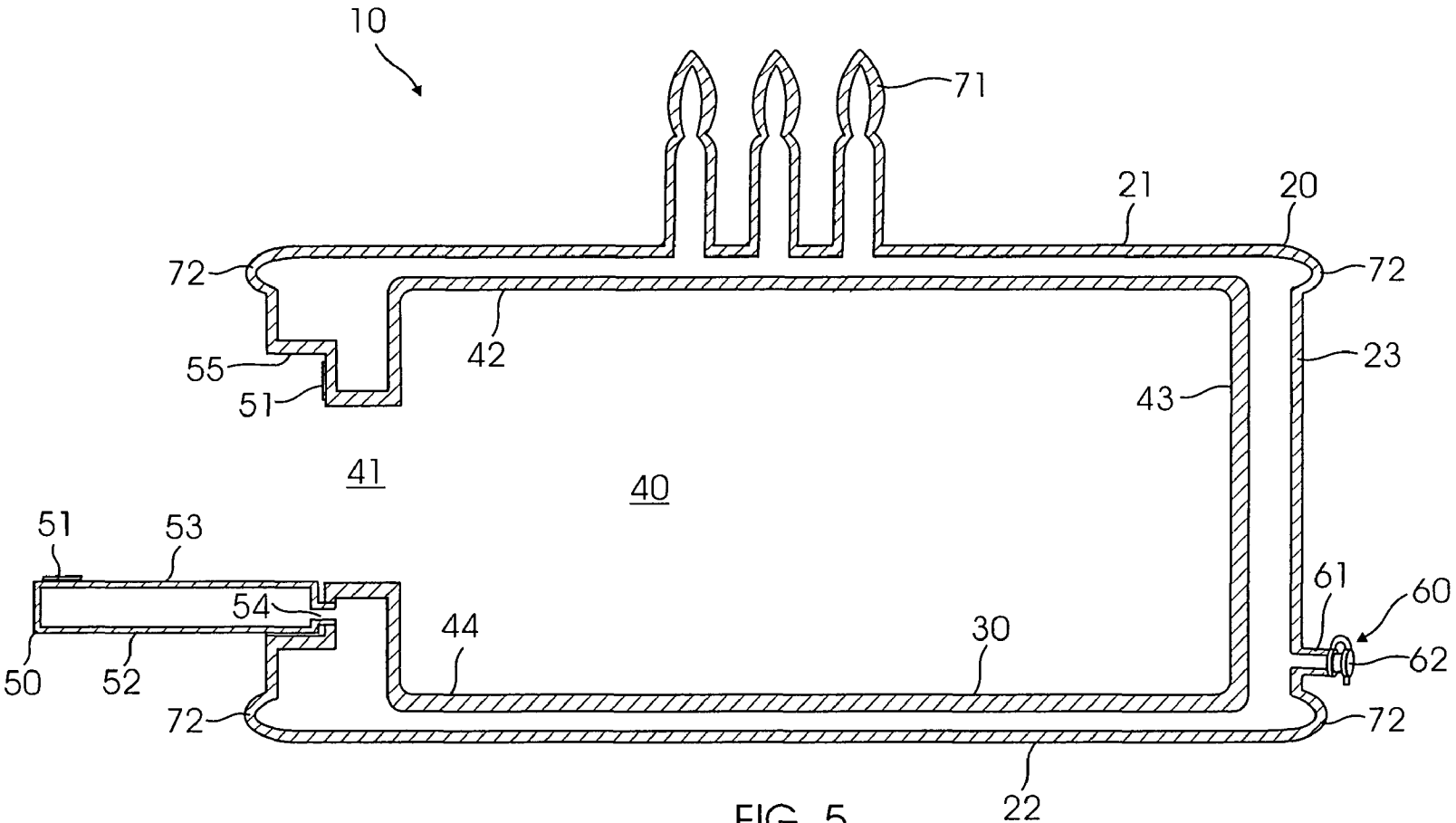
FIG. 5 is an illustration of an orthographic, cross-sectional, schematic representation view of the air flow pattern of a preferred embodiment of the inflatable container in the shape of a cake of FIG. 4 showing the flap in an open position.

Referring to FIGS. 4 and 5, there is illustrated a cross sectional, schematic view of the air flow pattern of the preferred embodiment.

Valve stopper 62 is removed from the valve nipple 61 to allow air to enter or exit the rectangular air bladder 10 through the valve 60. Air is retained in the air bladder by replacing valve stopper 62 in valve nipple 61 and thereby temporarily sealing valve 60. Air blown into the rectangular air bladder 10 flows through the entire open areas of the rectangular air bladder 10, which lie between the outer surface 20 and the interior surface 30, which comprises the entirety of cavity 40 and inner flap surface 53. This results in inflation of flap 50, ornamental top decorations 71, and ornamental side decorations 72. This also results in separation by force of air of the outer surface 20 and interior surface 30, thereby structurally creating and separating outer top wall 21 and cavity ceiling 42, outer bottom wall 22 and cavity floor 44, outer side walls 23 and cavity walls 43, and outer flap surface 52 and inner flap surface 53. When inflated, the cavity 40 does not necessarily follow the contours of the outer surface 20; each has its unique inflated shape, curve and silhouette.

FIGS. 4 and 5 also illustrates the features of flap 50. FIG. 4 illustrates flap 50 in the closed position; FIG. 5 illustrates flap 50 in the open position. Flap 50 is also formed from the continuous piece that is the rectangular air bladder 10. Rectangular air bladder 10 narrows at the flap joint 54. This narrowing allows air to flow into the flap 50 and allows for movement and flexibility of flap 50. Flap 50, in the closed position, resides in a flap recess 54 in the body of rectangular air bladder 10. Rectangular air bladder 10 is shaped around flap 50, so as to have a general appearance as being in the same plane as outer surface 20, and also provides a surface against which the rim or a small portion of the inner flap surface 53 contacts. On the contact area of inner flap surface 53 is fastener 51 and on the corresponding contact area on rectangular air bladder 10 is the reciprocal fastener 51. Flap recess 55 lies along the interior of cavity opening 41, both of which are preferably rectangular shaped. Flap joint 54 preferably lies along the bottom of flap recess 55, but can also lie along any of the four sides of flap recess 55. For example, if flap joint 54 were to lie along the top side of flap recess 55, flap 50 would naturally hang in the closed position, thereby reducing or eliminating the need for fastener 51.

Figure 6:
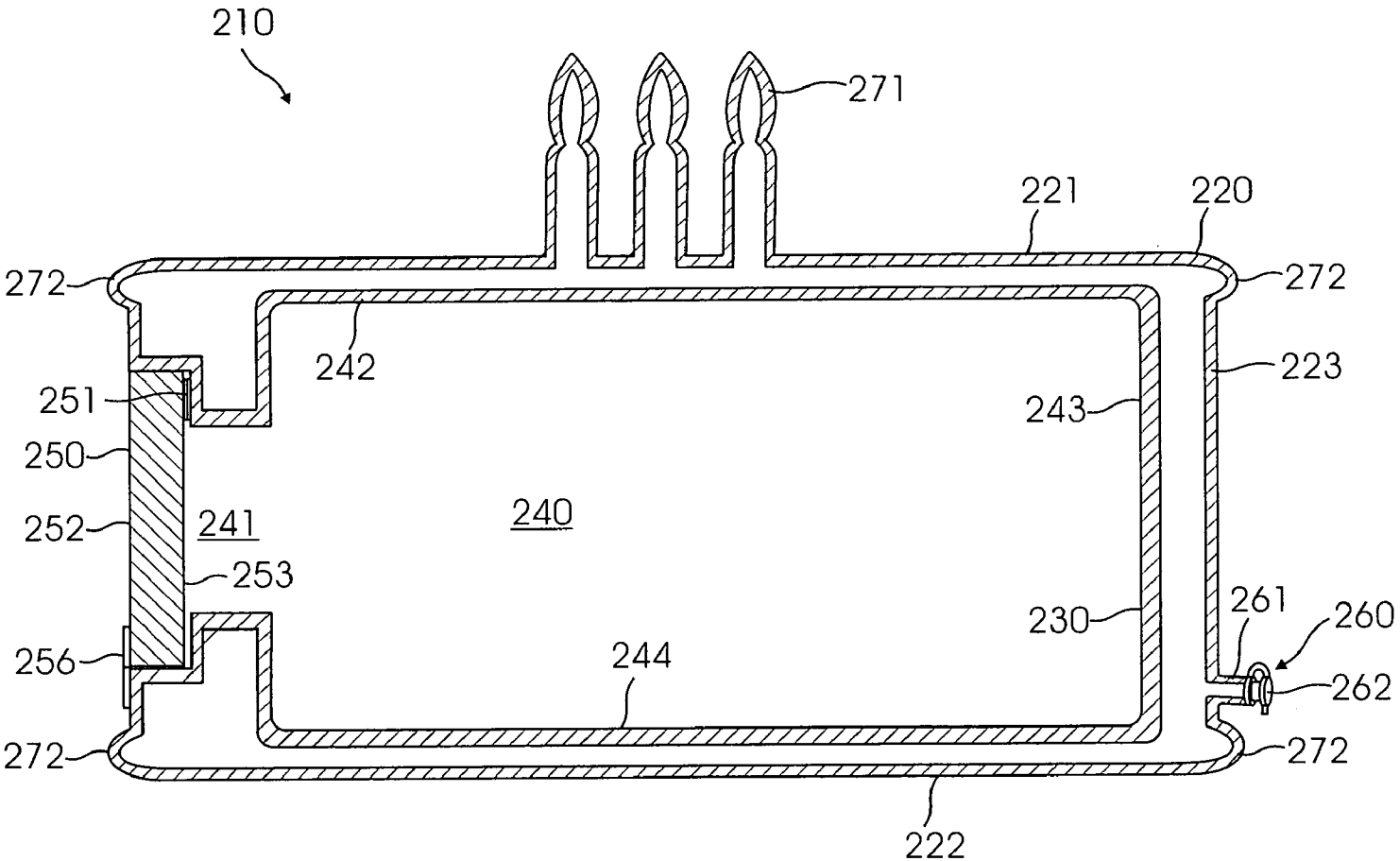
FIG. 6 is an illustration of an orthographic, cross-sectional, schematic representation view of the air flow pattern of the inflatable container in the shape of a cake highlighting an alternate embodiment of the flap shown in a closed position.
Figure 7:
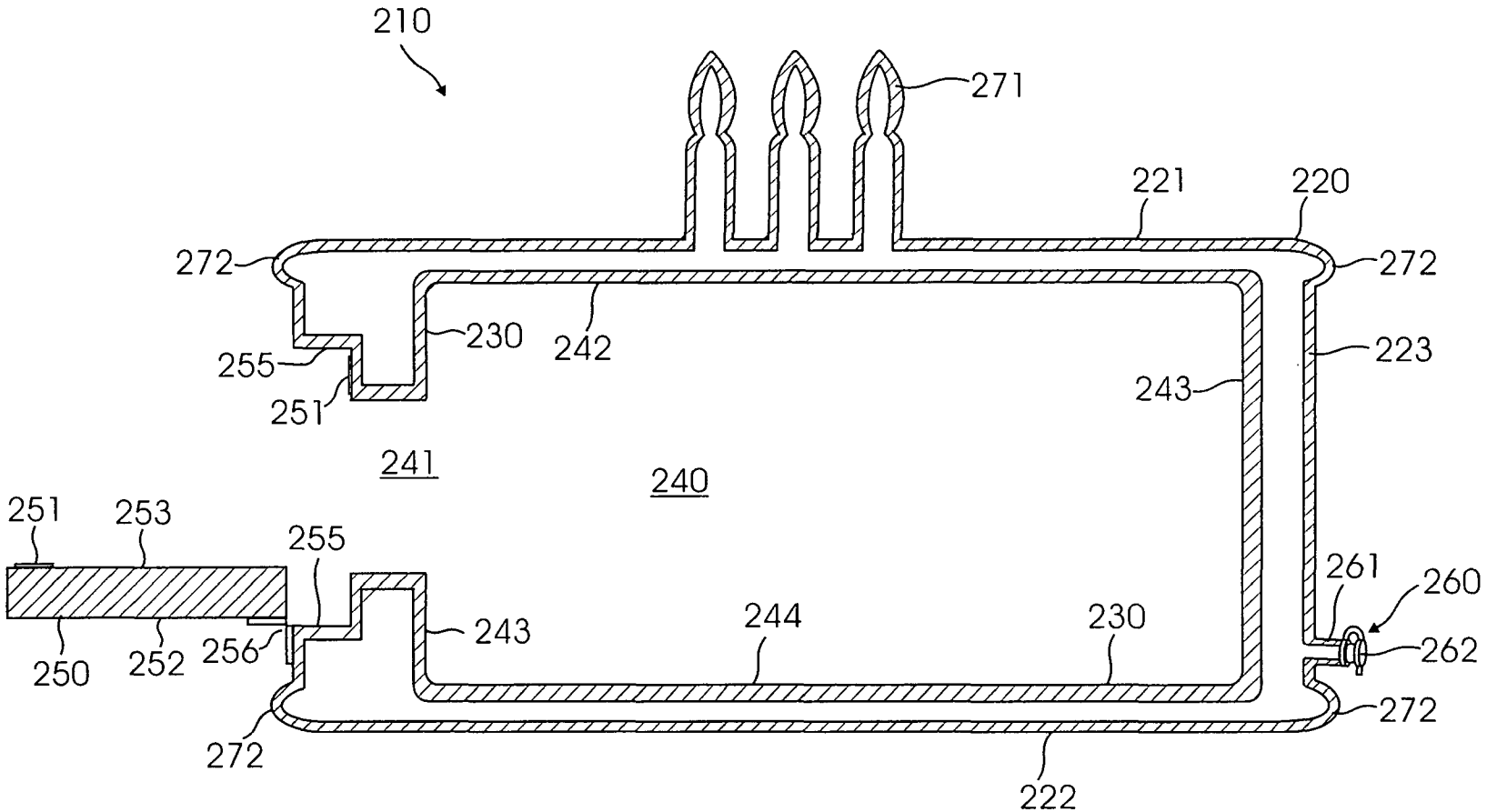
FIG. 7 is an illustration of an orthographic, cross-sectional, schematic representation view of the air flow pattern of the inflatable container in the shape of a cake of FIG. 6 highlighting an alternate embodiment of the flap shown in an open position.

FIGS. 6 and 7 illustrate an alternate embodiment of the flap and are otherwise substantially similar to FIGS. 4 and 5. Referring to FIGS. 6 and 7, there is illustrated a cross sectional, schematic view of the air flow pattern of an alternate embodiment.

Valve stopper 262 is removed from the valve nipple 261 to allows air to enter or exit the air bladder 210 through the valve 260. Air is retained in the air bladder by replacing valve stopper 262 in valve nipple 261 and thereby temporarily sealing valve 260. Air blown into the air bladder 210 flows through the entire open areas of the rectangular air bladder 210, which lie between the outer surface 220 and the interior surface 230, which comprises the entirety of cavity 240 and inner flap surface 243. This results in inflation of ornamental top decorations 271 and ornamental side decorations 272. This also results in separation by force of air of the outer surface 220 and interior surface 230, thereby structurally creating and separating outer top wall 221 and cavity ceiling 242, outer bottom wall 222 and cavity floor 244, outer side walls 223 and cavity walls 243. When inflated, the cavity 240 does not necessarily follow the contours of the outer surface 220; each has its unique inflated shape, curve and silhouette.

FIGS. 6 and 7 also illustrates the features of flap 250. FIG. 6 illustrates flap 250 in the closed position; FIG. 7 illustrates flap 250 in the open position. In the alternative embodiment, flap 250 is not inflated. Flap 250 may be a separate piece requiring a flap attachment 256, as shown, or may be also formed from the continuous piece that is the air bladder 210 having a formation and flap joint 256, in the flap recess 255. If flap 250 is created as a part of the continuous piece of air bladder 210, then flap joint 256 is a non-inflatable fold, such as a bead join, that is integrally joined to a non-inflatable panel that is flap 250.

Flap 250, in the closed position, resides in a flap recess 255 in the body of air bladder 210. Air bladder 210 is shaped around flap 250, so as to have a general appearance as being in the same plane as outer surface 220, and also provides a surface against which the rim or a small portion of the inner flap surface 253 contacts. On the contact area of inner flap surface 253 is fastener 251 and on the corresponding contact area on air bladder 210 is the reciprocal fastener 251. Flap recess 255 lies along the interior of cavity opening 241, both of which are preferably rectangular shaped. Flap joint 256 preferably lies along the bottom of flap recess 255, but can also lie along any of the four sides of flap recess 255. For example, if flap joint 256 were to lie along the top side of flap recess 255, flap 250 would naturally hang in the closed position, thereby reducing or eliminating the need for fastener 251.

Defined in detail, the present invention is an inflatable container comprising: (a) an air bladder with a top end, a bottom end and sidewalls extending downwardly from the top end to the bottom end to form a generally rectangular shape and an interior hollow chamber bounded by a interior surface, the sidewall and interior surface having an aperture by which access is gained to the interior chamber; (b) an outer surface that also forms ornamental decoration elements in fluid communication with the air bladder including ornamental top decorations and ornamental side decorations and on which space is provided for decorative wording; (c) a flap covering said aperture leading to said interior hollow chamber and mounted on said sidewall of said housing, the flap in fluid communication with the air bladder; (d) a fastening means to secure said flap in a closed position over the aperture leading to said interior chamber; and (e) valve means through which the air bladder, decorative elements and flap covering are inflated and means to seal the valve after inflation of the air bladder, decorative elements and flap covering.

Defined broadly, the present invention is an inflatable container comprising: (a) an air bladder with a top end, a bottom end and sidewalls extending downwardly from the top end to the bottom end to form a closed shape and an interior hollow chamber bounded by a inner surface and an aperture by which entrance is gained to the interior chamber; (b) an outer surface that also forms ornamental decoration elements in fluid communication with the air bladder; (c) a flap covering said aperture leading to the interior hollow chamber and mounted on said sidewall, the flap in fluid communication with the air bladder; (d) a fastening means to secure said flap in a closed position over the aperture leading to said interior chamber; and (e) valve means through which the air bladder, decorative elements and flap covering are inflated and means to seal the valve after inflation of the air bladder, decorative elements and flap covering.

Defined more broadly, the present invention is an inflatable container comprising: (a) an air bladder with a top end, a bottom end and sidewalls extending downwardly from the top end to the bottom end to form a closed shape and an interior hollow chamber bounded by a inner surface and an aperture by which entrance is gained to the interior chamber; (b) an outer surface that also forms ornamental decoration elements in fluid communication with the air bladder; (c) a flap covering said aperture leading to the interior hollow chamber and mounted on said sidewall; (d) a fastening means to secure said flap in a closed position over the aperture leading to said interior chamber; and (e) valve means through which the air bladder and decorative elements are inflated and means to seal the valve after inflation of the air bladder and decorative elements.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An inflatable container comprising:

a. an air bladder with a top end, a bottom end and sidewalls extending downwardly from the top end to the bottom end to form a generally rectangular shape and an interior hollow chamber bounded by a interior surface, the sidewall and interior surface having an aperture by which access is gained to the interior chamber;

b. an outer surface that also forms ornamental decoration elements in fluid communication with the air bladder including ornamental top decorations and ornamental side decorations and on which space is provided for decorative wording;

c. a flap covering said aperture leading to said interior hollow chamber and mounted on said sidewall of said housing, the flap in fluid communication with the air bladder;

d. a fastening means to secure said flap in a closed position over the aperture leading to said interior chamber; and e. valve means through which the air bladder, decorative elements and flap covering are inflated and means to seal the valve after inflation of the air bladder, decorative elements and flap covering.

2. The inflatable container in accordance with claim 1 wherein said ornamental top decorative elements are in the shape of candles.

3. The inflatable container in accordance with claim 1 wherein said ornamental side decorations are in the shape of icing.

4. The inflatable container in accordance with claim 1 wherein said interior hollow chamber is of sufficient size to retain a six pack of canned drinks.

5. The inflatable container in accordance with claim 1 wherein said decorative wording includes the group consisting of happy anniversary, to, from, happy 21$^{st}$ birthday, and happy new year.

6. An inflatable container comprising:

a. an air bladder with a top end, a bottom end and sidewalls extending downwardly from the top end to the bottom end to form a closed shape and an interior hollow chamber bounded by a inner surface and an aperture by which entrance is gained to the interior chamber;

b. an outer surface that also forms ornamental decoration elements in fluid communication with the air bladder;

c. a flap covering said aperture leading to the interior hollow chamber and mounted on said sidewall, the flap in fluid communication with the air bladder;

d. a fastening means to secure said flap in a closed position over the aperture leading to said interior chamber; and e. valve means through which the air bladder, decorative elements and flap covering are inflated and means to seal the valve after inflation of the air bladder, decorative elements and flap covering.

7. An inflatable container in accordance with claim 6 wherein said closed shape is rectangular.

8. An inflatable container in accordance with claim 6 wherein said closed shape is cylindrical.

9. An inflatable container in accordance with claim 6 wherein said ornamental decorations further comprises ornamental top decorations and ornamental side decorations.

10. An inflatable container in accordance with claim 6 further comprising ornamental wording on at least one surface.

11. The inflatable container in accordance with claim 9 wherein said ornamental top decorative elements are in the shape of candles.

12. The inflatable container in accordance with claim 9 wherein said ornamental side decorations are in the shape of icing.

13. The inflatable container in accordance with claim 6 wherein said interior hollow chamber is of sufficient size to retain a six pack of canned drinks.

14. The inflatable container in accordance with claim 10 wherein said decorative wording includes the group consisting of happy anniversary, to, from, happy 21$^{st}$ birthday, and happy new year.

15. An inflatable container comprising:

a. an air bladder with a top end, a bottom end and sidewalls extending downwardly from the top end to the bottom end to form a closed shape and an interior hollow chamber bounded by a inner surface and an aperture by which entrance is gained to the interior chamber;

b. an outer surface that also forms ornamental decoration elements in fluid communication with the air bladder;

c. a flap covering said aperture leading to the interior hollow chamber and mounted on said sidewall;

d. a fastening means to secure said flap in a closed position over the aperture leading to said interior chamber; and e. valve means through which the air bladder and decorative elements are inflated and means to seal the valve after inflation of the air bladder and decorative elements.

16. An inflatable container in accordance with claim 15 wherein said closed shape is rectangular.

17. An inflatable container in accordance with claim 15 wherein said closed shape is cylindrical.

18. An inflatable container in accordance with claim 15 wherein said ornamental decorations further comprises ornamental top decorations and ornamental side decorations.

19. An inflatable container in accordance with claim 15 further comprising ornamental wording on at least one surface.

20. The inflatable container in accordance with claim 18 wherein said ornamental top decorative elements are in the shape of candles.

21. The inflatable container in accordance with claim 18 wherein said ornamental side decorations are in the shape of icing.

22. The inflatable container in accordance with claim 15 wherein said interior hollow chamber is of sufficient size to retain a six pack of canned drinks.

23. The inflatable container in accordance with claim 19 wherein said decorative wording includes the group consisting of happy anniversary, to, from, happy $21^{st}$ birthday, and happy new year.

* * * * *